United States Patent [19]

Haines et al.

[11] Patent Number: 5,025,863

[45] Date of Patent: Jun. 25, 1991

[54] ENHANCED LIQUID HYDROCARBON RECOVERY PROCESS

[75] Inventors: Hiemi K. Haines, Englewood; Teresa G. Monger, Parker; Douglas E. Kenyon, Littleton, all of Colo.; Lance J. Galvin, Sugarland, Tex.

[73] Assignee: Marathon Oil Company, Findlay, Ohio

[21] Appl. No.: 535,926

[22] Filed: Jun. 11, 1990

[51] Int. Cl.[5] ..... E21B 43/18; E21B 43/25

[52] U.S. Cl. ..... 166/305.1; 166/263

[58] Field of Search ..... 166/263, 269, 305.1

[56] References Cited

U.S. PATENT DOCUMENTS

| | | | |
|---|---|---|---|
| 1,787,972 | 1/1931 | Doherty | 166/263 |
| 2,788,855 | 4/1957 | Peterson . | |
| 3,064,728 | 11/1962 | Gould | 166/263 X |
| 3,120,263 | 2/1964 | Hoyt . | |
| 3,120,265 | 2/1964 | Allen . | |
| 3,123,134 | 3/1964 | Kyte et al. | 166/263 |
| 3,252,512 | 5/1966 | Baker et al. | 166/263 |
| 3,292,703 | 12/1966 | Weber . | |
| 3,465,823 | 9/1969 | Jacoby et al. | 166/263 |
| 3,762,474 | 10/1973 | Allen et al. | 166/305.1 |
| 3,841,406 | 10/1974 | Burnett | 166/305.1 |
| 3,882,941 | 5/1975 | Pelofsky | 166/263 X |
| 3,995,693 | 12/1976 | Cornelius | 166/268 |
| 4,098,339 | 7/1978 | Weisz et al. | 166/305.1 |
| 4,187,910 | 2/1980 | Cornelius et al. | 166/305.1 |
| 4,205,723 | 6/1980 | Clauset, Jr. | 166/305.1 X |
| 4,390,068 | 6/1983 | Patton et al. | 166/267 |
| 4,560,003 | 12/1985 | McMillen et al. | 166/305.1 |
| 4,638,863 | 1/1987 | Wilson | 166/248 |
| 4,846,276 | 7/1989 | Haines | 166/273 |

OTHER PUBLICATIONS

Kieschnick, Jr., "What is Miscible Displacement?", *The Petroleum Engineer,* Aug. 1959, pp. B56, 66, 70, 77, 80, 84, 96, 98.

*Primary Examiner*—George A. Suchfield

*Attorney, Agent, or Firm*—Jack L. Hummel; Jack E. Ebel

[57] ABSTRACT

A process for the enhanced recovery of liquid hydrocarbons from a subterranean hydrocarbon-bearing formation wherein natural gas which is immiscible with the liquid hydrocarbons is injected into the formation via a well. The well is shut in for a period of time to permit the natural gas to render the liquid hydrocarbons mobile and thereafter the mobilized liquid hydrocarbons are produced from the well.

10 Claims, No Drawings

ENHANCED LIQUID HYDROCARBON RECOVERY PROCESS

FIELD OF THE INVENTION

The present invention relates to a process for the enhanced recovery of liquid hydrocarbons from a subterranean hydrocarbon-bearing formation wherein natural gas which is immiscible with liquid hydrocarbons is injected into the formation via a well, and more particularly, to such a process involving the cyclic injection of natural gas via a well in fluid communication with the formation and subsequent production of hydrocarbons, including natural gas, from the well after a predetermined period of time has lapsed which is sufficient to permit the natural gas to stimulate recovery of hydrocarbons.

BACKGROUND OF THE INVENTION

Conventionally, liquid hydrocarbons are produced to the surface of the earth from a subterranean hydrocarbon-bearing formation via a well penetrating and in fluid communication with the formation. Usually, a plurality of wells are drilled and placed in fluid communication with the subterranean hydrocarbon-bearing formation to effectively produce liquid hydrocarbons from a particular subterranean reservoir. Approximately 20 to 30 percent of the volume of hydrocarbons originally present within a given reservoir in a subterranean formation can be produced by the natural pressure of the formation, i.e. by primary production. Secondary recovery processes have been employed to produce additional quantities of original hydrocarbons in place in a subterranean formation. Such secondary recovery processes include non-thermal processes involving the injection of a drive fluid, such as water, via wells designated as injection wells into the formation to drive liquid hydrocarbons to separate wells designated for production of hydrocarbons to the surface. Successful secondary recovery processes may result in the recovery of about 30 to 50 percent of the original hydrocarbons in place in a subterranean formation. Once a secondary recovery process has been operated to its economic limit, i.e. the profit from the sale of hydrocarbons produced as a result of the process is less than the operating expense of the process per se, tertiary recovery processes have been utilized to recover an additional incremental amount of the original liquid hydrocarbons in place in a subterranean formation by altering the properties of liquid hydrocarbons, e.g. altering surface tension. Examples of tertiary recovery processes include micellar and surfactant flooding processes. Tertiary recovery processes also include processes which involve the injection of a thermal drive fluid, such as steam, or a gas, such as carbon dioxide, which is miscible with liquid hydrocarbons.

Secondary and tertiary recovery operations often involve the injection of a drive fluid via one or more wells designated as injection wells into the subterranean formation to drive liquid hydrocarbons in place to at least one or more separate wells designated as production wells for production of hydrocarbons to the surface. Another process commonly applied to a given well is a cyclic injection/production process. This process, also referred to as "huff-n-puff", entails injecting a fluid via the single well into a subterranean hydrocarbon-bearing formation so as to contact hydrocarbons in place in the near-wellbore environment of the subterranean formation surrounding the well. Thereafter, the well may be "shut in" for a period of time. The well is then returned to production and an incremental volume of liquid hydrocarbons is produced from the formation to the surface. Carbon dioxide, flue gas, and steam have been previously used in such cyclic injection/production process. Such cyclic injection/production processes as applied to a well involve a relatively small capital investment, and hence, a normally quick pay out period. However, a suitable source via pipeline or truck of carbon dioxide or nitrogen is often not available near the well to be treated. Moreover, the use of a thermal fluid, such as steam, requires relatively expensive surface equipment which may be impractical in remote or offshore locations due to constraints of space. Accordingly, a need exists for a cyclic injection/production process for the enhanced recovery of liquid hydrocarbons from a subterranean hydrocarbon-bearing formation through a well in fluid communication therewith which involves injection of a fluid which is readily and widely available and which can be implemented without large spatial requirements.

Thus, it is an object of the present invention to provide a process for the enhanced recovery of liquid hydrocarbons from a subterranean hydrocarbon-bearing formation which is easily implemented and operated.

It is another object of the present invention to provide such a process which utilizes a fluid which is normally available at a given well site and which results in the recovery of a significant increment of liquid hydrocarbons from the subterranean formation.

It is further object of the present invention to provide such a process which can be repeated in multiple cycles, each cycle resulting in the recovery of a significant increment of liquid hydrocarbon from the subterranean formation.

It is still a further object of the present invention to provide such a process which is relatively inexpensive.

SUMMARY OF THE INVENTION

The present invention provides a process for enhancing the recovery of liquid hydrocarbons from a subterranean formation by injecting natural gas into the formation via a well in fluid communication with the formation. The natural gas is injected at a pressure such that the natural gas is immiscible with the liquid hydrocarbons and at a temperature which is insufficient to significantly mobilize liquid hydrocarbons in the formation. Thereafter, the well is shut in for a period of time of about 1 to about 100 days which is sufficient to render the liquid hydrocarbons mobile and to permit at least partial solution of the natural gas in the liquid hydrocarbons. The well is subsequently placed in production and formation hydrocarbons mobilized by the injected natural gas are produced to the surface via the well. The process is particularly applicable to an undersaturated watered-out subterranean hydrocarbon-bearing formation. The process of the present invention may be repeated at least once to achieve additional incremental recovery of liquid hydrocarbons from the formation.

DETAILED DESCRIPTION OF THE PREFERRED EMBODIMENTS

The present invention relates to a process for the enhanced recovery of liquid hydrocarbons from a subterranean hydrocarbon-bearing formation wherein a slug or volume of natural gas is injected into the formation via a well in fluid communication with the formation. As utilized throughout this specification, "natural gas" denotes a gas produced from a subterranean formation, and usually, principally containing methane with lesser amounts of ethane, propane, butane and those intermediate hydrocarbon compounds having greater than 4 carbon atoms, and which also may include hydrogen, nitrogen, carbon dioxide, carbon monoxide, hydrogen sulfide, or mixtures thereof. The natural gas is immiscible with liquid hydrocarbons present in the formation. As utilized throughout this specification, "immiscible" denotes that the natural gas which is injected into the formation does not develop miscibility with the liquid hydrocarbons in place in the formation. Thereafter, the well is shut in for a predetermined period of time, i.e. a soak period, which is sufficient to render the liquid hydrocarbons mobile and to permit at least partial solution of the natural gas in the liquid hydrocarbons. The well is subsequently placed in production and formation hydrocarbons mobilized by the injected natural gas and assisted by any existing reservoir energy are produced to the surface via the well by conventional production equipment and techniques as will be evident to the skilled artisan.

The process of the present invention can be applied to a relatively broad range of subterranean hydrocarbon-bearing formations varying from relatively shallow formations, e.g., 300 m. or less in depth, to relatively deep formations, e.g. 4,000 m. or more in depth, and being at a relatively high pressure, e.g. 40,000 kPa, to being pressure depleted. The process of the present invention can be applied as a primary production process, as a secondary recovery process, as a supplement to an active waterflooding process, as a tertiary recovery process, or as a supplement to a tertiary recovery process. The process may be applied to a homogeneous or heterogeneous sandstone or a carbonate formation. The formation may contain liquid hydrocarbons ranging in density from light to heavy, be under saturated or undersaturated conditions, and contain mobile or immobile water. Preferably, the process of the present invention can be applied to subterranean formations containing relatively light oil, e.g. 35° API gravity, at undersaturated condition with a reservoir pressure below the minimum miscibility pressure of the injected gas, and more particularly, to such a formation which has been watered-out by either natural influx or by a secondary waterflooding process. The process is also applicable to offshore wells which are remote from non-natural gas sources and which have surface space constraints. The process of the present invention can be practiced via any well in fluid communication with the formation.

The volume of natural gas injected in accordance with the first step of the present invention may vary from about 300 $m^3$ to about 30,000,000 $m^3$ depending upon the composition of the natural gas, the temperature and pressure of the liquid hydrocarbon reservoir, and the thickness and porosity of the formation. Preferably, the volume of the slug of natural gas injected should be sufficient to contact hydrocarbons in the subterranean formation within a radius of about 50 meters from the injection wellbore. Although injection of natural gas at ambient temperature is preferred, the temperature of the injected natural gas slug can vary from gas liquefaction temperature to above the temperature of the reservoir due to the available source and the heat of compression, respectively. In any event, the temperature of the injected natural gas is not sufficient to significantly mobilize liquid hydrocarbons in the formation from a thermal recovery process standpoint. The exact temperature of the injected natural gas depends upon the source thereof, the phase behavior of the reservoir oil, the heat incurred in compressing the gas, and the wellbore's mechanical integrity. The natural gas is injected into the formation at as fast a rate as possible without exceeding the formation parting pressure, i.e. the fraction pressure, or damaging the wellbore completion, e.g. gravel pack.

The soak period utilized in the process of the present invention can vary from about 1 to about 100 days depending upon the reservoir conditions and ongoing field operations. Preferably, the soak period should maximize the particular oil recovery mechanism which is sought by the process of the present invention. For example, a shorter soak period should be utilized to obtain maximum reservoir re-pressurization and the benefits attendant therewith, while a longer soak would emphasize phase behavior benefits and the advantages thereof. Pressure in the wellbore during the soak period should be monitored downhole or at the wellhead to ascertain the degree of reservoir re-pressurization.

Upon the termination of the soak period, the well is placed back in production and formation hydrocarbons mobilized by the injected natural gas are produced until hydrocarbon production rates decline to that forecast in the absence of the process of the present invention, e.g. baseline waterflood decline rate. A back pressure may be applied during production so as to minimize gas break out and to enhance phase behavior benefits from oil swelling and oil viscosity reduction. Such back pressure can be applied by initially flowing the well through an adjustable choke. Depending upon the composition of the injected natural gas slug and the requirements of surface facilities, early gas production can be temporarily isolated. However, normal production operations are ultimately resumed.

The steps of the process of the present invention can be repeated in multiple cycles to a given well. The process of the present invention as applied to a given well can be coordinated with the process as applied to at least one other well in fluid communication with the formation. The process of the present invention can be applied in conjunction with secondary or tertiary recovery processes. For example, the process of the present invention can be applied in conjunction with a water-alternating-gas flooding process, such as described in U.S. Pat. No. 4,846,276 by interrupting water-alternate-gas injection with at least one cycle of the process of the present invention.

The following examples demonstrate the practice and utility of the present invention but are not to be construed as limiting the scope thereof.

EXAMPLE 1

A cylindrical sandstone core in its native state is prepared for a natural gas injection and production process in accordance with the present invention. The core is about 20.37 cm long and about 7.38 cm in diameter and has an average permeability of 2 md. The core is maintained at a pressure of about 26,200 kPa and a temperature of about 82° C. The core is saturated with a recombined oil resulting in an initial oil in place of 81.5 percent of the core's pore volume. The recombined oil has the following composition:

| Components | Material Balance (wt. %) |
|---|---|
| Nitrogen | 0.83 |
| Carbon dioxide | 0.01 |
| Methane | 2.51 |
| Ethane | 1.07 |
| Propane | 2.21 |
| iso-Butane | 0.83 |
| n-Butane | 2.00 |
| iso-Pentane | 1.00 |
| n-Pentane | 1.25 |
| Hexanes | 3.40 |
| Heptanes-plus | 84.89 |

The recombined oil has an API gravity of about 35.3° API, a viscosity of 0.9 cp and a density of 0.74 g/cc at the conditions recited above.

Two flooding fluids are prepared for the natural gas injection and production process. The water is a synthetic produced brine having the following composition:

| Component | Concentration (g/L) |
|---|---|
| NaCl | 17.88 |
| $Na_2SO_4$ | 0.32 |
| $CaCl_2$ | 9.80 |
| $MgCl_2.6H_2O$ | 0.45 |

The gas is a produced natural gas from a formation in proximity to the formation from where the core is obtained. The composition of the natural gas is as follows:

| Component | Concentration (mole %) |
|---|---|
| Nitrogen | 1.26 |
| Carbon dioxide | 0.10 |
| Methane | 98.53 |
| Ethane | 0.11 |

The minimum miscibility pressure of the natural gas in the recombined oil is about 36,000 kPa and the bubble point pressure is about 12,800 kPa. The operating pressure of the present process noted above, 26,200 kPa, is between these levels.

Initially, the core is waterflooded to completion with the synthetic brine at a low flow rate (10 cc/hr) until oil is not produced. The water injection rate is then increased to a high rate (100 cc/hr) and continued until oil production completely ceases again. This entire flooding stage is termed the "Waterflood." Thereafter, natural gas at 82° C. is injected at the outlet at a low flow rate (10 cc/hr) and water is produced from the inlet. The slug size of 28.5% PV was designed so that only brine was displaced during gas injection (no gas breakthrough.) This stage is termed the "huff". Thereafter, the core is shut in for a three-day soak period. This flooding stage is termed the "soak."

Thereafter, water produced during the "huff" stage is injected at the core inlet with production of incremental oil at the core outlet. This stage is termed the "puff." These huff, soak, puff stages can be repeated, but for example 1, the flood is then terminated after the first cycle. The cumulative percentage of original oil in place (% OOIP) and the incremental % OOIP for each stage of the present invention are shown in table 1 below.

TABLE 1

| Initial oil in place (% pore volume): 81.5 | | | |
|---|---|---|---|
| Flooding Stage | Volume Injected (Pore volume) | Cumulative % OOIP | Incremental % OOIP |
| Waterflood | 1.55 | 54 | — |
| Huff | .285 | 54 | 0 |
| Soak | 0 | 54 | 0 |
| Puff | 1.00 | 65.8 | 11.8 |

As indicated in table 1, the initial waterflood only recovered 54% of the original oil in place in the core. The natural gas cyclic injection/production process of the present invention recovered an additional 11.8% of the original oil in place which represents incremental oil which could not have been recovered by only waterflooding.

EXAMPLE 2

A cylindrical sandstone core in its cleaned state is prepared for a natural gas injection and production process in accordance with the present invention. The core is about 19.5 cm long and about 7.38 cm in diameter and has an average permeability of 2 md. The core is maintained at a pressure of about 26,200 kPa and a temperature of about 82° C. The core is saturated with a separator oil resulting in an initial oil in place of 56.8 percent of the core's pore volume. The separator oil has the following composition:

| Components | Material Balance (wt. %) |
|---|---|
| Methane | .234 |
| Ethane | .287 |
| Propane | 1.38 |
| iso-Butane | .9 |
| n-Butane | 2.185 |
| iso-Pentane | 1.678 |
| n-Pentane | 2.17 |
| Hexanes | 3.83 |
| Heptanes-plus | 87.33 |

The separator oil has an API gravity of about 35.3° API, a viscosity of 2 cp and a density of 0.847 g/cc at the conditions recited above.

Two flooding fluids are prepared for the huff-n-puff natural gas injection and production process. The water is a synthetic produced brine having the following composition:

| Component | Concentration (g/L) |
|---|---|
| NaCl | 17.88 |
| $Na_2SO_4$ | 0.32 |
| $CaCl_2$ | 9.80 |
| $MgCl_2.6H_2O$ | 0.45 |

The gas is a produced natural gas from a formation in proximity to the formation from where the core is obtained. The composition of the natural gas is as follows:

| Component | Concentration (mole %) |
|---|---|
| Nitrogen | 1.26 |
| Carbon dioxide | 0.10 |

-continued

| Component | Concentration (mole %) |
|---|---|
| Methane | 98.53 |
| Ethane | 0.11 |

Initially, the core is waterflooded to completion with the synthetic brine at a low flow rate (10 cc/hr) until oil is not produced. The water injection rate is then increased to a high rate (100 cc/hr) and continued until oil production completely ceases again. This entire flooding stage is termed the "Waterflood." Thereafter, natural gas at 82° C. is injected at the outlet at a low flow rate (10 cc/hr) and allowing production from the inlet. The slug size of 25.0% PV was designed so that only brine was displaced during gas injection (no gas breakthrough.) This stage is termed the "huff". Thereafter, the core is shut in for a three-day soak period. This flooding stage is termed the "soak."

Thereafter, water produced during the "huff" stage is injected at the core inlet with production of incremental oil at the core outlet. This stage is termed the "puff." These huff, soak, puff stages are repeated. The cumulative percentage of original oil in place (% OOIP) and the incremental % OOIP for each stage of each cycle of the present invention is shown in table 2 below.

TABLE 2

| Flooding Stage | Initial oil in place (% pore volume): 56.8 Volume Injected (Pore volume) | Cumulative % OOIP | Incremental % OOIP |
|---|---|---|---|
| Waterflood | .95 | 42.6 | — |
| Huff #1 | .25 | 42.6 | 0 |
| Soak | 0 | 42.6 | 0 |
| Puff #1 | .5 | 53.4 | 10.8 |
| Huff #2 | .25 | 53.4 | 0 |
| Soak | 0 | 53.4 | 0 |
| Puff #2 | .5 | 67.5 | 14.1 |

As the tabulated results indicate, the initial waterflood only recovered 42.6% of the original oil in place in the core. The first cycle of the natural gas cyclic injection/production process of the present invention recovered an additional 10.8% of the original oil in place which represents incremental oil which could not have been recovered by only waterflooding. And the second cycle of the natural gas cyclic injection/production process recover an additional total 14.1% of the original oil in place. Thus, a combined total of 24.9% of the original oil in place was recovered in addition to that which could have been recovered only by waterflooding. Further, it is important to note that the second cycle of the natural gas cyclic injection/production process of the present invention resulted in a greater incremental oil recovery than the first cycle which is unexpected since previous cyclic injection/production processes utilizing carbon dioxide, flue gas or steam have resulted in decreasing incremental oil production for each successive cycle performed.

While the foregoing preferred embodiments of the invention have been described and shown, it is understood that the alternatives and modifications, such as those suggested and others, may be made thereto and fall within the scope of the invention.

We claim:

1. A process for the recovery of liquid hydrocarbons from a subterranean hydrocarbon-bearing formation consisting essentially of:

(a) injecting natural gas into the formation via a well in fluid communication with the formation, said natural gas being at a temperature which is insufficient to significantly mobilize light density oil in the formation and at a pressure such that said natural gas is immiscible with said light density oil in the formation, said natural gas being injected in a volume sufficient to contact light density oil in the formation within a radius from the well of about 50 meters;

(b) shutting in said well for a period of time of about 1 to about 100 days which is sufficient to render the contacted light density oil mobile; and (c) producing the light density oil which has been mobilized by solution of said natural gas from the well.

2. The process of claim 1 wherein said volume is from about 300 $M^3$ to about 30,000,000 $m^3$.

3. The process of claim 1 wherein the steps (a), (b) and (c) are repeated at least once.

4. The process of claim 1 wherein said natural gas is injected into the formation at as high a rate as possible without exceeding the fracture pressure of the formation.

5. A process for the recovery of light density oil from a undersaturated watered-out subterranean hydrocarbon-bearing formation consisting essentially of:

(a) injecting natural gas into the formation via a well in fluid communication with the formation at a pressure such that the natural gas is immiscible with the light density oil and in a volume sufficient to contact light density oil in the formation within a radius from the well of about 50 meters;

(b) shutting in said well for a period of time of about 1 to about 100 days which is sufficient to render the contacted light density oil mobile; and (c) producing the light density oil which has been mobilized by solution of said natural gas from the well.

6. The process of claim 5 wherein said volume is from about 300 $m^3$ to about 30,000,000 $m^3$.

7. The process of claim 5 wherein the steps (a), (b) and (c) are repeated at least once.

8. The process of claim 5 wherein said natural gas is injected at a temperature which is insufficient to significantly mobilize the liquid hydrocarbons present in the formation.

9. The process of claim 5 wherein said natural gas is injected into the formation at as high a rate as possible without exceeding the fracture pressure of the formation.

10. The process of claim 7 wherein the density of the light oil is about 35° API.

* * * * *

UNITED STATES PATENT AND TRADEMARK OFFICE

CERTIFICATE OF CORRECTION

PATENT NO. : 5,025,863

DATED : June 25, 1991

INVENTOR(S) : Hiemi K. Haines et al.

It is certified that error appears in the above-identified patent and that said Letters Patent is hereby corrected as shown below:

Col. 8, line 59: Delete "claim 7" and insert --claim 5--.

Signed and Sealed this

Thirteenth Day of October, 1992

*Attest:*

DOUGLAS B. COMER

*Attesting Officer*

*Acting Commissioner of Patents and Trademarks*